US010923857B2

(12) United States Patent
Wagner et al.

(10) Patent No.: US 10,923,857 B2
(45) Date of Patent: Feb. 16, 2021

(54) CONNECTOR MODULE AND CONNECTOR FOR TRANSMITTING HF SIGNALS

(71) Applicant: ODU GmbH & Co. KG, Mühldorf (DE)

(72) Inventors: Cornelia Wagner, Mühldorf (DE); Stefan Franzl, Töging (DE); Markus Seidl, Kastl (DE)

(73) Assignee: ODU GmbH & Co. KG, Mühldorf (DE)

( * ) Notice: Subject to any disclaimer, the term of this patent is extended or adjusted under 35 U.S.C. 154(b) by 0 days.

(21) Appl. No.: 16/243,075

(22) Filed: Jan. 8, 2019

(65) Prior Publication Data

US 2019/0237907 A1 Aug. 1, 2019

(30) Foreign Application Priority Data

Jan. 31, 2018 (EP) ..... 18154519

(51) Int. Cl.

| | |
|---|---|
| ***H01R 13/6471*** | (2011.01) |
| ***H01R 13/24*** | (2006.01) |
| ***H01R 13/514*** | (2006.01) |
| ***H01R 12/71*** | (2011.01) |

(52) U.S. Cl.

CPC ..... *H01R 13/6471* (2013.01); *H01R 12/714* (2013.01); *H01R 13/2428* (2013.01); *H01R 13/2442* (2013.01); *H01R 13/514* (2013.01)

(58) Field of Classification Search

CPC ..... H01R 13/22–2492; H01R 13/719; H01R 13/24; H01R 23/7073; H01R 23/722; H01R 23/688; H01R 23/6873; H01R 13/6471; H01R 13/514; H01R 13/2428; H01R 12/714

USPC ..... 439/660, 66, 108

See application file for complete search history.

(56) References Cited

U.S. PATENT DOCUMENTS

| | | | | |
|---|---|---|---|---|
| 3,042,895 A | | 7/1962 | Bonhomme | |
| 3,399,372 A | | 8/1968 | Uberbacher et al. | |
| 3,587,029 A | * | 6/1971 | Knowles | H01R 13/6471 439/607.34 |

(Continued)

FOREIGN PATENT DOCUMENTS

| | | |
|---|---|---|
| CN | 102544925 A | 7/2012 |
| CN | 106252994 A | 12/2016 |

(Continued)

*Primary Examiner* — Gary F Paumen

(57) ABSTRACT

A connector module comprises an insulating body, and further comprises a plurality of signal contact elements and a plurality of shield contact elements forming a connector face configured for establishing electric contact with a counterpart of the connector module. For each of the signal contact elements, there exist two or at most three shield contact elements that are closer to this signal contact element than any signal contact element of the plurality of signal contact elements. The signal contact elements are arranged along a first curve extending in the connector face of the connector module and the shield contact elements are arranged along a second curve extending in the connector face of the connector module, the first curve and the second curve being parallel curves having a predefined normal distance. Viewed along the course of the parallel curves, the signal contact elements and the shield contact elements are arranged alternatingly.

15 Claims, 13 Drawing Sheets

(56) References Cited

U.S. PATENT DOCUMENTS 4,161,346 A * 7/1979 Cherian ..... H01R 12/714 439/515
5,331,514 A * 7/1994 Kuroda ..... H01L 23/49827 174/255
5,611,696 A * 3/1997 Donner ..... H01R 13/2435 439/66
6,146,157 A 11/2000 Lenoir et al.
6,241,531 B1 6/2001 Roath et al.
6,287,132 B1 * 9/2001 Perino ..... H05K 1/14 439/101
6,881,100 B2 4/2005 Barry et al.
7,771,210 B2 * 8/2010 Cherian ..... G01R 1/0466 439/66
9,859,635 B1 * 1/2018 Pickel ..... H01R 12/716
9,972,948 B2 * 5/2018 Wagner ..... H01R 24/50
2002/0013095 A1 * 1/2002 Katoh ..... H01R 13/6471 439/625
2004/0048500 A1 * 3/2004 Sweetland ..... H01R 13/2407 439/67
2006/0019538 A1 * 1/2006 Davis ..... H01R 13/514 439/607.11
2008/0214059 A1 * 9/2008 Rothermel ..... H01R 13/6471 439/701
2009/0221164 A1 * 9/2009 Kobayashi ..... H01R 13/514 439/108
2009/0224785 A1 * 9/2009 Breinlinger ..... G01R 1/06772 324/756.01
2010/0136849 A1 * 6/2010 Kato ..... H01R 13/6471 439/709
2010/0291803 A1 * 11/2010 Kirk ..... H01R 23/688 439/660
2010/0330844 A1 * 12/2010 Ito ..... H01R 12/716 439/660
2013/0095698 A1 4/2013 Ju et al.
2015/0011122 A1 * 1/2015 Chang ..... H01R 13/2442 439/607.09
2016/0359280 A1 * 12/2016 Wagner ..... H01R 13/2421

FOREIGN PATENT DOCUMENTS

CN 106797098 A 5/2017
EP 1531527 B1 6/2007
JP 2003242837 A 8/2003
JP 2007-324029 A 12/2007
JP 2016-115468 A 6/2016
JP 2017-004945 A 1/2017
WO 2016048352 A1 3/2016

* cited by examiner

CONNECTOR MODULE AND CONNECTOR FOR TRANSMITTING HF SIGNALS

CROSS REFERENCE TO RELATED APPLICATIONS

The present application claims the benefit of European Patent Application No. 18154519.5 filed on Jan. 31, 2018, the contents of which are incorporated herein by reference in its entirety.

DESCRIPTION

Field of the Invention

The invention relates to a connector module comprising an insulating body, a plurality of signal contact elements and a plurality of shield contact elements. The invention further relates to an array of connector modules comprising at least two connector modules. Moreover, the invention relates to an electric connector comprising the connector module.

Background of the Invention

From U.S. patent U.S. Pat. No. 3,399,372 A an arrangement of a printed circuit card and a socket receiving the card is known. The printed circuit card has narrow, closely spaced, alternated ground and signal contact tabs while the socket has signal contacts formed from wire and ground contacts formed from sheet metal. A plastic housing of the socket has slots in its top and bottom walls for positioning the ground contacts.

A similar arrangement is known from U.S. patent U.S. Pat. No. 3,587,029 A, where a socket-type connector comprises a row of interspaced resilient signal and ground contact members disposed in a recess in the connector body and adapted to make contact with the terminals of the plug-in board when the board is inserted in the recess. On the outside of the body of connector a metallic conductive shield is provided, that has insulated tabs to provide insulation between the shield and signal contacts and uninsulated tabs to permit electrical contact with ground contact members.

U.S. patent application U.S. 2010/0136849 A1 discloses a connector comprising pairs of signal contacts and pairs of ground contacts disposed in a housing of the connector along a predetermined arranging direction. The contacts have S-shaped spring sections which can press contact portions of the contacts against the electrodes of a card-type electronic device.

Similarly, the European patent EP 1 531 527 B1 describes a connector having a contact group and an insulator for holding the contact group. The contact group comprises pairs of signal contacts and pairs of ground contacts wherein each pair of signal contacts is arranged adjacently between the ground contacts of a pair of ground contacts.

OBJECT OF THE INVENTION

It is an object of the present invention to provide an improved connector module comprising an insulating body, a plurality of signal contact elements and a plurality of shield contact elements. In particular, the connector module shall be suitable for high-quality transmission of HF signals at low cost. The invention also aims at providing an improved array of connector modules comprising at least two of the connector modules. Moreover, the invention seeks to provide an improved electric connector comprising the connector module.

Solution According to the Invention

According to the invention, the problem is solved by a connector module. The connector module comprising an insulating body, a plurality of signal contact elements and a plurality of shield contact elements, the signal contact elements and the shield contact elements forming a connector face configured for establishing electric contact with a counterpart of the connector module. For each of the signal contact elements, there exist two or at most three shield contact elements that are closer to this signal contact element than any signal contact element of the plurality of signal contact elements. The signal contact elements are arranged along a first curve extending in the connector face of the connector module and the shield contact elements are arranged along a second curve extending in the connector face of the connector module, the first curve and the second curve being parallel curves having a predefined normal distance. Viewed along the course of the first and the second curve (below for conciseness also referred to as "the parallel curves"), the signal contact elements and the shield contact elements are arranged alternatingly.

The counterpart with which the connector face of the connector module can establish electric contact can for example be a circuit board. Preferably, the signal contact elements and the shield contact elements are arranged such that electric contact between the signal contact elements and the shield contact elements is established when the connecting face is pressed against a counterpart.

In the context of the present invention, a curve that is parallel to a given curve is defined as a curve whose points are at a predefined normal distance from a given curve. The first curve and the second curve are distinct curves in the sense that the normal distance is greater than zero. Advantageously, the alternating arrangement of the contact elements, which are arranged along the first curve, and the shield contact elements, which are arranged along the second curve, yields a zigzag of the signal contact elements and the shield contact elements where the signal contact elements are shielded by adjacent shield contact element.

In the context of the present invention, "arranged along" a curve shall mean that the contact elements' centres are disposed close enough to the first curve that the shortest distance between a contact element's centre and the curve is small compared to the predefined distance between the first and the second curve. In this regard, "small" shall mean that the shortest distance between a signal contact element's centre and the first curve is less than 20% of the normal distance between the first and the second curve, further preferably less than 15% of the predefined normal distance, further preferably less than 10% of the predefined normal distance and further preferably less than 5% of the predefined normal distance between the curves. In this respect, the centre of the signal contact element is the orthogonal projection of the contact element's centre of mass onto the connector face.

As far as the present invention requires that shield contact elements are closer to a certain signal contact element than any of the other signal contact elements, "closer" is meant to refer to the proximity as defined by the shortest distance between the contact elements involved. For conciseness, in the following the shortest distance in this context is referred to simply as the "distance". For conciseness, the shield contact elements that are closer to a signal contact element than any of the other signal contact elements in the following also be referred to as the "associated" shield contact elements of this signal contact element. These associated shield contact elements can provide an efficient shielding of the signals transmitted by the signal contact elements. It is an achievable advantage of such shielding that crosstalk between neighbouring signal contact elements is reduced. The preferred connector module is capable of transmitting high frequency (HF) signals.

A signal contact element's associated shield contact elements can provide for an efficient shielding of the signal contact element. Advantageously, the displacement of the shield contact elements relatively to the signal contact that results from the two types of elements arrange on parallel curves, can increase the shortest distance between the signal contact elements and their associated shield contact elements without the need to increase the distance between neighbouring signal contact elements. Moreover, since the distance between the signal contact elements and their associated shield contact elements is one of the factors that determine the arrangement's impedance, the inventions allows for achieving a matched impedance even with closely spaced contact elements. Accordingly, with the invention a particularly compact connector module can be provided. In addition, the shape and the dielectric properties of the insulating body can have an impact on the impedance. Accordingly, by means of adjusting the shape of the insulating body, for example by providing pockets of air and by varying the wall thicknesses, as well as by means of selecting a suitable material of the insulating body, the impedance can be matched to the particular requirements of the intended application of the connector module.

It is an achievable advantage of the invention that the signal contact elements and the shield contact elements can be manufactured at low cost, thereby providing in many applications a cost effective alternative to more expensive coaxial connectors.

The problem according to the invention is also solved by a connector module. The connector module comprising an insulating body, a plurality of signal contact elements and a plurality of shield contact elements, the signal contact elements and the shield contact elements forming a connector face configured for establishing electric contact with a counterpart of the connector module. For each of the signal contact elements, there exist two or at most three shield contact elements that are closer to this signal contact element than any signal contact element of the plurality of signal contact elements. The shield contact elements are implemented as S-contacts. Preferably, the signal contact elements are also implemented as S-contacts.

In the context of the present invention, an "S-contact" is a contact comprising at least the first portion with a first turn having a first curvature direction and the second portion with a second turn having a second curvature direction, the second curvature direction being opposite to the first curvature direction. The S-contact may comprise any number of further turns with curvatures in any direction. The turns may be sharp or gradual.

Advantageously, the S-shape of a shield contact element provides three or more adjacent traverse parts connected by the curved portions. These traverse parts, in combination, can at an appropriate frequency have an electrical effect similar to that of a full plate shield, for example the plate of a plate capacitor. The inventors also refer to this effect as a "pseudo shield". As a result, the S-shaped shield contacts can advantageously provide a highly efficient shielding geometry.

It is a further achievable advantage of the S-shaped contact elements that they can be manufactured at low cost, for example from sheet metal or wire. A connector module of this kind can for example be particularly suitable for HF transmission.

The problem according to the invention is further solved by an array of connector modules. The array of connector modules comprises at least two connector modules as described above, wherein the at least two connector modules are combined to form an array. Advantageously, by assembling two or more connector modules into an array of connector modules, a large number of signal contact elements can be provided. This allows for transmitting a large number of signals in parallel.

Moreover, the problem according to the invention is solved by an electrical connector. The electrical connector comprises at least one connector module as described above and a receptacle configured for accommodating a counterpart. The connector module is configured and arranged such that the signal contact elements and the shield contact elements of the connector module establish electrical contacts with contact pads and/or conducting paths of the counterpart when the counterpart is introduced into the receptacle. The counterpart may for example be an electrical circuit board.

PREFERRED EMBODIMENTS OF THE INVENTION

Preferred features of the invention which may be applied alone or in combination are discussed below.

Preferably, for each of the signal contact elements the distance to the nearest two or at most three associated shield contact elements is less than the distance to a neighbouring signal contact element, whereas the distance to the other shield contact elements is equal to or above the distance between the signal contact element and a neighbouring signal contact element.

In a preferred embodiment of the invention, for each of the signal contact elements there exist exactly two shield contact elements that are closer to this signal contact element than any signal contact element of the plurality of signal contact elements. This embodiment of the invention exploits the inventor's finding that providing two associated shield contact elements for a signal contact element under consideration can be sufficient for effectively shielding the signals transmitted via the signal contact elements relative to neighbouring signal contact elements.

Preferably, the distances between a signal contact element and any one of the signal contact element's associated shield contact elements are equal to one another. Advantageously, in this embodiment of the invention each of the associated shield contact elements can provide the same contribution to the signal contact element's impedance. As a result, the adjustment of the impedance can be simplified. The distance between the signal contact element and an associated shield contact element can for example be adjusted by varying the distance between the first curve and the second curve.

A preferred shield contact element is arranged on the second curve at a position where the distance to the nearest one or two signal contact elements is less than the distance to a neighbouring shield contact element. Preferably, in case a shield contact element is arranged on the second curve at a position where the distance to the two nearest signal contact elements is less than the distance to a neighbouring shield contact element, the shield contact element is configured for electrically shielding the two nearest signal contact elements. It is an achievable advantage of this embodiment of the invention that the shield contact element is shared between the two nearest signal contact elements and contributes to the shielding of the two signal contact elements. Advantageously, by providing shared shielding elements, the number of shielding elements is reduced. Preferably, the number of shield contact elements exceeds the number of signal contact elements by one.

The preferred second curve is located laterally to the first curve. The signal contact elements preferably are arranged along the first curve at regular spacing intervals. Similarly, the shield contact elements preferably are arranged along the second curve at regular spacing intervals. Preferably, all the signal contact elements of the connector module are arranged along the first curve. Preferably, all the shield contact elements of the connector module are arranged along the second curve.

Along the course of the parallel curves, the signal contact elements preferably are disposed at intermediate positions between neighbouring shield contact elements, respectively. Preferably, for each pair of neighbouring shield contact elements, one signal contact element is disposed at an intermediate position between the neighbouring shield contact elements of said pair, respectively. Accordingly, the signal contact element is shielded by the two associated shield contact elements.

Preferably, along the course of the parallel curves, the signal contact elements are disposed at intermediate positions between neighbouring shield contact elements, respectively, wherein for each pair of neighbouring shield contact elements, one signal contact element is disposed at an intermediate position between the neighbouring shield contact elements of said pair, said arrangement resulting in a zigzag pattern of signal contact elements and shield contact elements. Due to the zigzag pattern, the length of the connector module can be reduced. A compact connector module is obtained.

The parallel curves can have any shape. Preferably, at any location along the course of the parallel curves, their radius of curvature is greater than the shortest distance between the curves, more preferably twice or more, more preferably 5 time or more, more preferably 10 times or more. In a preferred embodiment of the invention, the parallel curves are parallel straight lines. In other words, the signal contact elements are arranged along a first straight line at the connector face of the connector module, wherein the shield contact elements are arranged along a second straight line at the connector face of the connector module, the second straight line being parallel to the first straight line.

The second straight line preferably is located laterally to the first straight line. The preferred second straight line is arranged at the predetermined distance from the first straight line. Preferably, the signal contact elements are arranged along the first straight line at regular spacing intervals. Preferably, the shield contact elements are arranged along the second straight line at regular spacing intervals. A regular arrangement of the contact elements can be preferred because, especially in the field of HF transmission, it may simplify the adjustment of the impedance and allows for reducing signal reflections.

In a preferred embodiment of the invention, all the signal contact elements of the connector module are arranged along the first straight line. Preferably, all the shield contact elements of the connector module are arranged along the second straight line.

When viewed in the direction along the first straight line, the signal contact elements on the first straight line and the shield contact elements on the second straight line preferably are arranged alternatingly. When viewed in the direction along the second straight line, the signal contact elements preferably are disposed at intermediate positions between neighbouring shield contact elements, respectively. Preferably, for each pair of neighbouring shield contact elements, one signal contact element is disposed at an intermediate position between the neighbouring shield contact elements of said pair, respectively.

The distance between neighbouring signal contact elements along the first straight line preferably is equal to the distance between neighbouring shield contact elements along the second straight line. Along the two straight lines, the contact elements preferably are evenly spaced.

Preferably, the positions of the shield contact elements along the second straight line are shifted in the direction of the second straight line relative to the positions of the signal contact elements along the first straight line by half the spacing between neighbouring signal contact elements. This implies that in this embodiment of the invention the distance between signal contact elements and associated shield contact elements is always kept constant. Preferably, when viewed in the direction of the first straight line, the positions of the signal contact elements are located halfway between the positions of the shield contact elements, respectively.

The signal contact elements and the shield contact elements can for example be realised as bent parts. Preferably, the signal contact elements and the shield contact elements are realised as spring contacts. Advantageously, due to the resilient property of the spring contacts the electrical contact with contact pads or conduction paths of a counterpart like for example a circuit board can be improved. Preferably, the signal contact elements and the shield contact elements are realised as stamped sheet metal parts. Sheet metal parts are suitable for being used as spring contact elements and, advantageously, can be manufactured at low cost.

Preferably, the signal contact elements and the shield contact elements have the identical shapes. This can simplify the manufacture of the invention. Moreover, an improved shielding can be achieved with this embodiment of the invention.

The signal contact elements and the shield contact elements preferably do not comprise any insulating layer or insulating coating. Also preferably, each of the signal contact elements and the shield contact elements comprises a metal strip or a wire. In a preferred embodiment of the invention, each of the signal contact elements and the shield contact elements comprises a contact tip protruding from the connector face of the connector module, the contact tip being configured for electrically contacting a contact pad or a conducting path of a second circuit board. It is preferred that each of the signal contact elements and the shield contact elements comprises a solder tab, the solder tab being configured for being soldered to a contact pad or a conducting path of the first circuit board.

Preferably the signal contact elements and/or the shield contact elements are realised as S-contacts. Preferably, the S-contact comprises at least a first portion with a first turn having a first curvature direction and a second portion with a second turn having a second curvature direction, the second curvature direction being opposite to the first curvature direction. Preferably, the signal contact elements and/or the shield contact elements are implemented as S-contacts each comprising a metal strip, preferably cut from sheet metal, or a wire, with the course of the metal strip or wire being a series of at least two turns or angles or alterations in course. Preferably, the S-contact comprises a metal strip or a wire, with the course of the metal strip or the wire being a zigzag course. Preferably, the first turn and the second turn are implemented as C-turns or as V-turns.

The preferred S-contact further comprises a transverse part connecting the first and the second portion. The transverse part divides the S-contact into two or more compartments. Advantageously, this may improve the shielding, because the electric field is prevented from extending through the S-contact. Preferably, each S-contact comprises a metal strip or a wire with a transverse part, the transverse part interconnecting the first and the second portion.

Preferably, the transverse part extending across more than 70% of the width of the respective S-contact, further preferably across more than 80% of the width of the respective contact element, further preferably across more than 90% of the width of the respective contact element.

The preferred S-contacts are oriented essentially orthogonally to the connector face. Yet, in some embodiments of the invention they can be inclined so that the orientation of the preferred S-contact and the connector face of the connector module between them enclose an angle of less than 90° Yet, preferably, the inclination is relatively small in that the S-contact and the connector face between them enclose an angle of at least 60°, further preferably at least 70°, further preferably at least 80°.

Preferably, S-contacts are oriented essentially parallel to each other. In this respect, being oriented essentially parallel to each other shall mean that the respective orientation of two neighbouring contact elements differs by at most 5°, further preferably by at most 3°.

The preferred connector module is configured for being mounted on a first circuit board, wherein the signal contact elements and the shield contact elements are configured for being electrically connected with conducting paths and/or contact pads of the first circuit board. Preferably, the signal contact elements and the shield contact elements are configured for being soldered to conducting paths and/or contact pads of the first circuit board. Preferably, each of the signal contact elements and the shield contact elements comprises a solder tab configured for soldering the contact to the first circuit board.

Preferably, the connector module is implemented as a butting connector configured for being pressed against conducting paths and/or contact pads of a second circuit board. The connector module provides a simple and convenient way for establishing electrical connections suitable for HF transmission. Preferably, the signal contact elements and the shield contact elements are implemented as pressure contacts configured for being pressed against conducting paths and/or contact pads of a second circuit board.

In a preferred embodiment of the invention the connector module is configured for establishing electric connections with conducting paths and/or contact pads of a second circuit board when the connector face of the connector module is pressed against the second circuit board. Preferably, the signal contact elements and the shield contact elements of the connector module are configured for electrically contacting conduction paths and/or contact pads of a second circuit board when the connector face of the connector module is pressed against the second circuit board.

Preferably, the signal contact elements of the connector module are configured for transmitting HF signals. Preferably, the signal contact elements of the connector module are configured for transmitting HF signals with frequencies above 20 MHz, more preferably above 50 MHz, more preferably above 100 MHz. In some embodiments, the connector module is suited for transmitting HF signals a frequency of up to 500 MHz. In a particularly preferred embodiment of the invention, the signal contact elements of the connector module are configured for transmitting HF signals related to coils of a magnetic resonance imaging apparatus. Transmission of imaging signals requires high quality HF transmission. The connector module according to the present invention is capable of fulfilling these demands.

The preferred insulating body is made of plastic material. Preferably, the insulating body is manufactured by injection moulding. Preferably, at least one of a material of the insulating body, a size of air-filled cavities in the insulating body and a distance between the first curve and the second curve is chosen or adjusted in order to bring an impedance of an impedance-controlled area to a predefined impedance value.

Preferably, an array of connector modules comprises a first connector module and a second connector module, the first connector module's second curve being located laterally to the second connector module's first curve, with the first connector module's shield contact elements being configured for contributing to shielding the second connector module's signal contact elements. Preferably, the array further comprises a first circuit board, with the at least two connector modules being electrically connected to the first circuit board. Preferably, the array further comprises a first circuit board, with the at least two connector modules being electrically connected to the first circuit board.

BRIEF DESCRIPTION OF THE DRAWING

In the following, further preferred embodiments of invention are illustrated by means of examples. The invention is not limited to these examples, however.

The drawings schematically show.

DETAILED DESCRIPTION OF EMBODIMENTS OF THE INVENTION

Figure 1A:
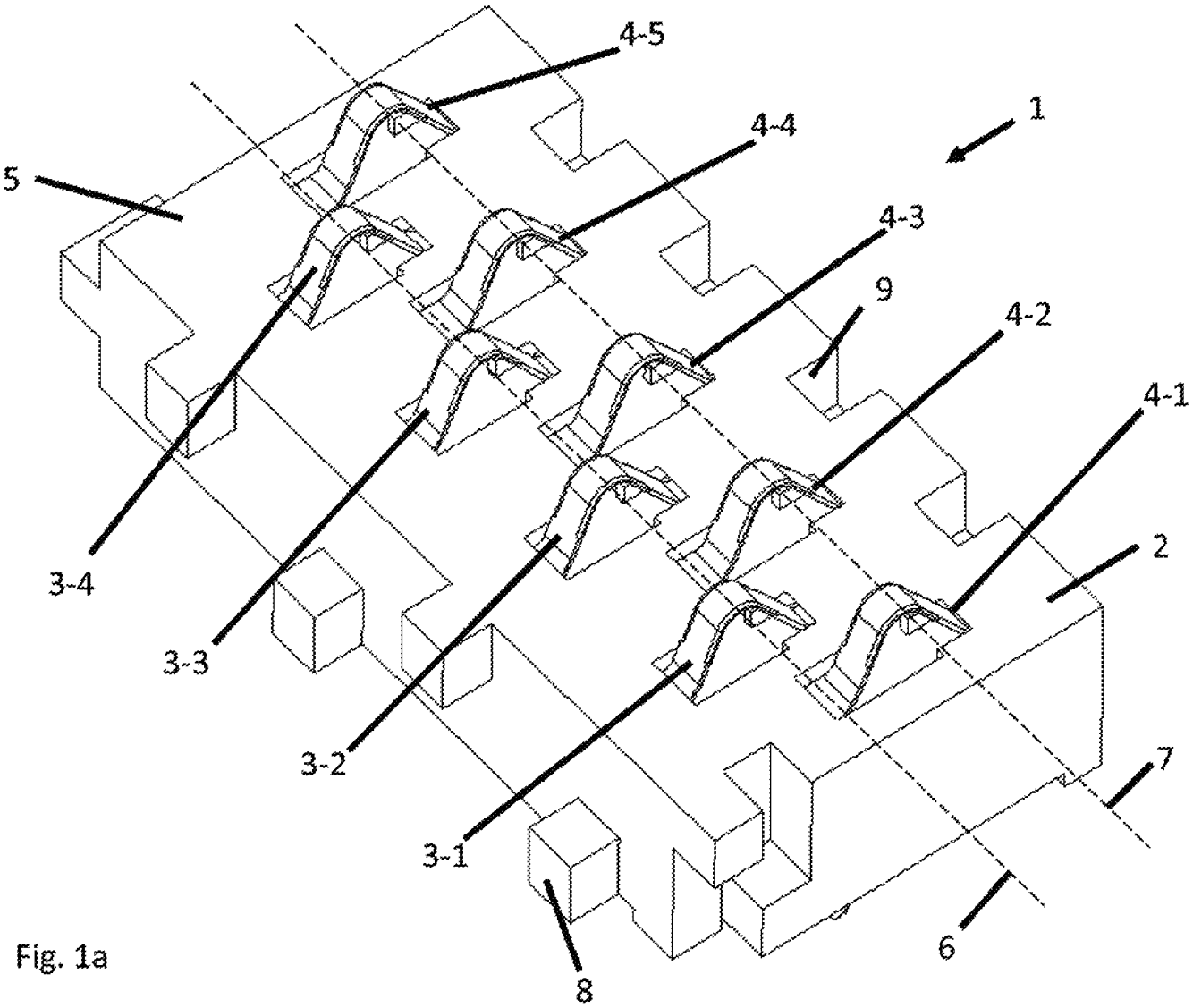
FIG. 1*a* shows a perspective view of a connector module.

In the following description of preferred embodiments of the present invention, identical reference numerals denote identical or comparable components.

Figure 1B:
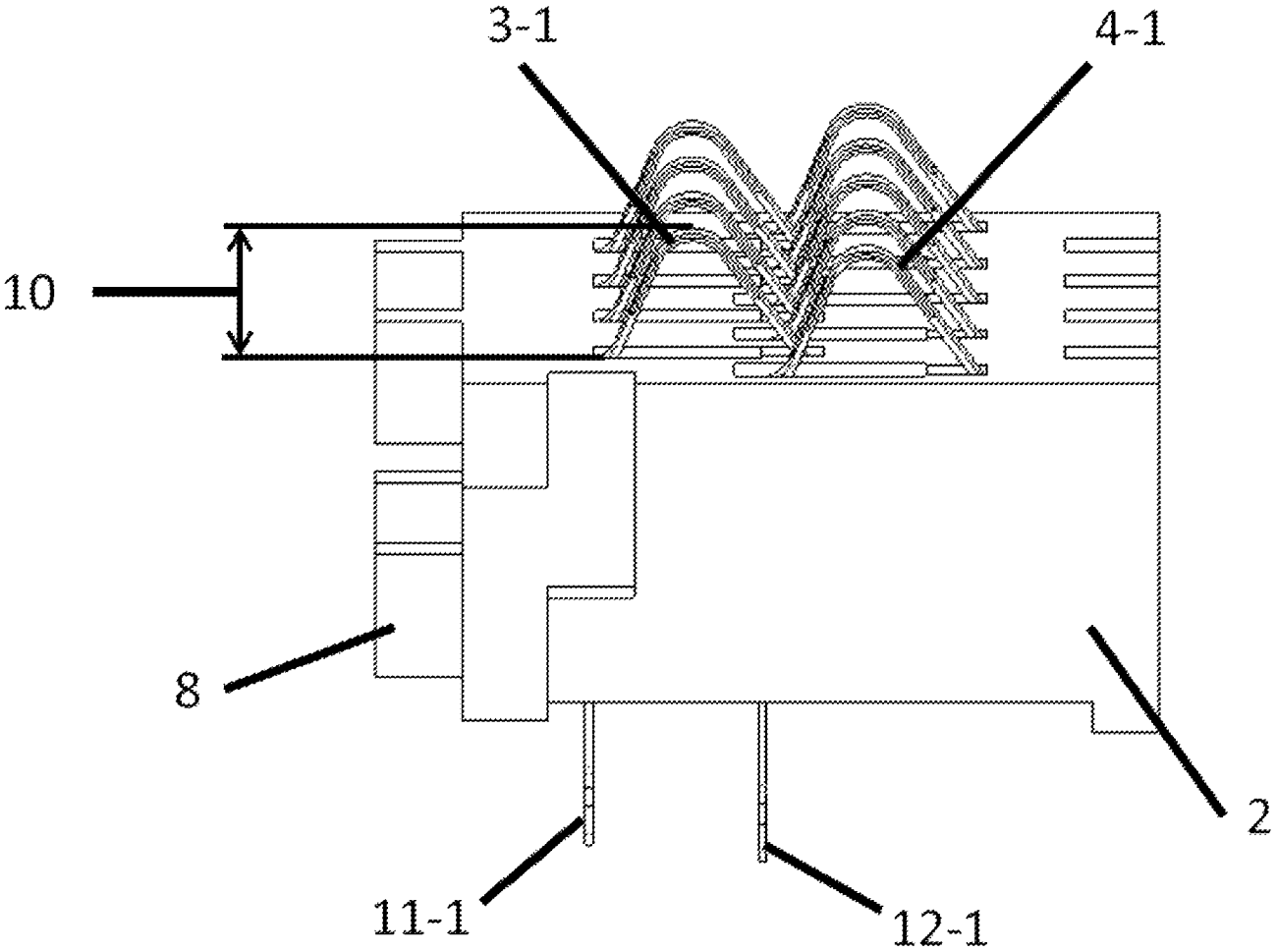
FIG. 1*b* shows a side view of the connector module.
Figure 1C:
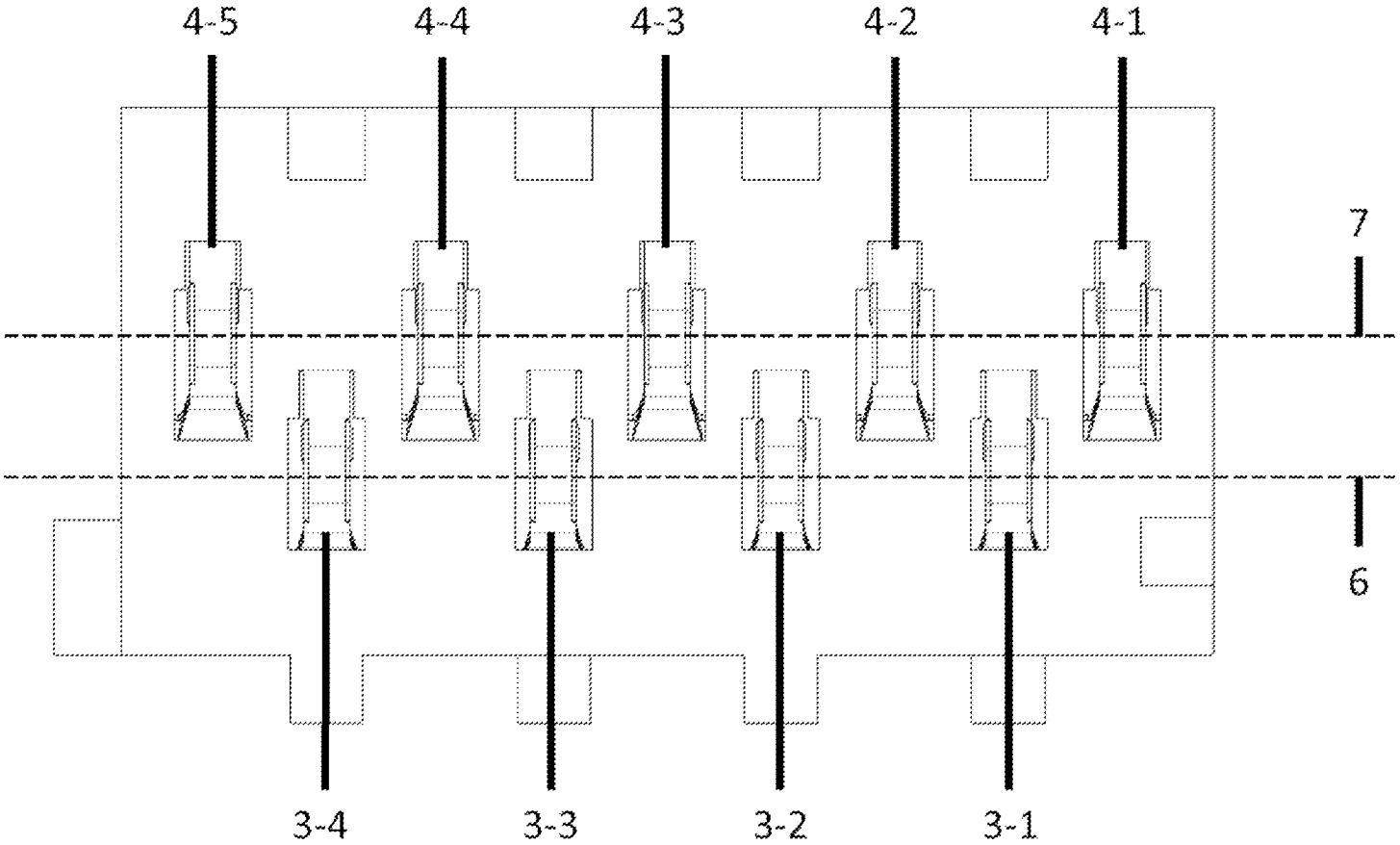
FIG. 1*c* shows a top view of the connector module.

FIGS. 1*a* to 1*c* show different views of a connector module 1 for an electric connector. The connector module 1 comprises an insulating body 2 made of insulating material, for example of plastic. Moreover, the connector module comprises a plurality of signal contact elements 3-1 to 3-4 and a plurality of shield contact elements 4-1 to 4-5. The signal contact elements 3-1 to 3-4 and the shield contact elements 4-1 to 4-5 are implemented as spring contact elements, with the contact tips of the spring contact elements protruding from the connector face 5 of the connector module 1. The connector module 1 with the spring contact elements is part of a butting connector. When the connector module 1 is pressed against a counterpart, for example against the surface of a circuit board, the signal contact elements 3-1 to 3-4 and the shield contact elements 4-1 to 4-5 are pressed against corresponding contact pads or tracks of the circuit board, in order to establish electric connections between the connector module 1 and the circuit board. In the example shown in FIG. 1*a*, the connector module 1 comprises four signal contact elements 3-1 to 3-4 arranged along a straight line 6. The signal contact elements 3-1 to 3-4 are arranged at regular spacing intervals along the straight line 6, with the straight line 6 extending in the longitudinal direction of the connector module 1. A second straight line 7 is arranged in parallel with the first straight line 6, with the shield contact elements 4-1 to 4-5 being arranged along the second straight line 7 at regular distances. The positions of the shield contact elements 4-1 to 4-5 are shifted in the longitudinal direction relative to the positions of the four signal contact elements 3-1 to 3-4 by half the spacing between neighbouring signal contact elements, so that an alternating arrangement of shield contact elements 4-1 to 4-5 and signal contact elements 3-1 to 3-4 is obtained.

The connector module 1 is particularly suited for transmitting high frequency signals, also referred to as HF signals, with a frequency of more than 20 MHz, more preferably more than 50 MHz, more preferably more than 100 MHz. The HF signals are transmitted via the signal contact elements 3-1 to 3-4. The shield contact elements 4-1 to 4-5 are configured for shielding the HF signals transmitted via the signal contact elements 3-1 to 3-4. Due to the presence of the shield contact elements 4-1 to 4-5, crosstalk between neighbouring signal contact elements is prevented.

The connector module 1 may for example be used for transmitting coil signals of an apparatus for magnetic resonance imaging (MRI), said coil signals typically having a frequency of between 50 and 200 MHz. Of course, the connector module 1 can be used for transmitting all kinds of signals and is neither restricted to transmission of HF signals nor to the field of magnetic resonance imaging. In the example shown in FIGS. 1*a* to 1*c*, the connector module comprises four signal contact elements 3-1 to 3-4 and five shield contact elements 4-1 to 4-5. The connector module 1 may as well comprise a different number of signal contact elements, with the number of corresponding shield contact elements being varied accordingly.

For transmitting a large number of signals, several connector modules may be assembled to form an array of connector modules. For this purpose, the lateral sides of the connector module 1 are equipped with protrusion elements 8 and rectangular recesses 9, wherein the protrusion elements 8 of a first connector module can be inserted into the rectangular recesses 9 of a neighbouring connector module, in order to enforce a well-defined alignment between the connector modules.

FIG. 1*b* depicts a side view of the connector module 1. It can be seen that the contact tips of the signal contact elements 3-1 to 3-4 and of the shield contact elements 4-1 to 4-5 protrude from the connector face 5. Both the signal contact elements 3-1 to 3-4 and the shield contact elements 4-1 to 4-5 are implemented as spring contact elements, said spring contact elements being deflected when the connector module 1 is pressed against a counterpart. The spring deflection 10, which may for example amount to 2 mm, is indicated in FIG. 1*b*. For electrically connecting the spring contact elements, each of the signal contact elements 3-1 to 3-4 and the shield contact elements 4-1 to 4-5 is equipped with a solder tab. For example, a solder tab 11-1 of the signal contact element 3-1 and a solder tab 12-1 of the shield contact element 4-1 protrude from the underside of the connector module 1. The connector module 1 may be mounted on a circuit board and the solder tabs of the spring contact elements may be soldered to conduction paths of the circuit board.

In FIG. 1*c*, a top view of the connector module 1 is shown. It can be seen that the four signal contact elements 3-1 to 3-4 are arranged along the first straight line 6, whereas the five shield contact elements 4-1 to 4-5 are arranged along the parallel second straight line 7. To accomplish an efficient shielding, the signal contact elements 3-1 to 3-4 are disposed at intermediate positions between the shield contact elements 4-1 to 4-5.

Figure 2A:
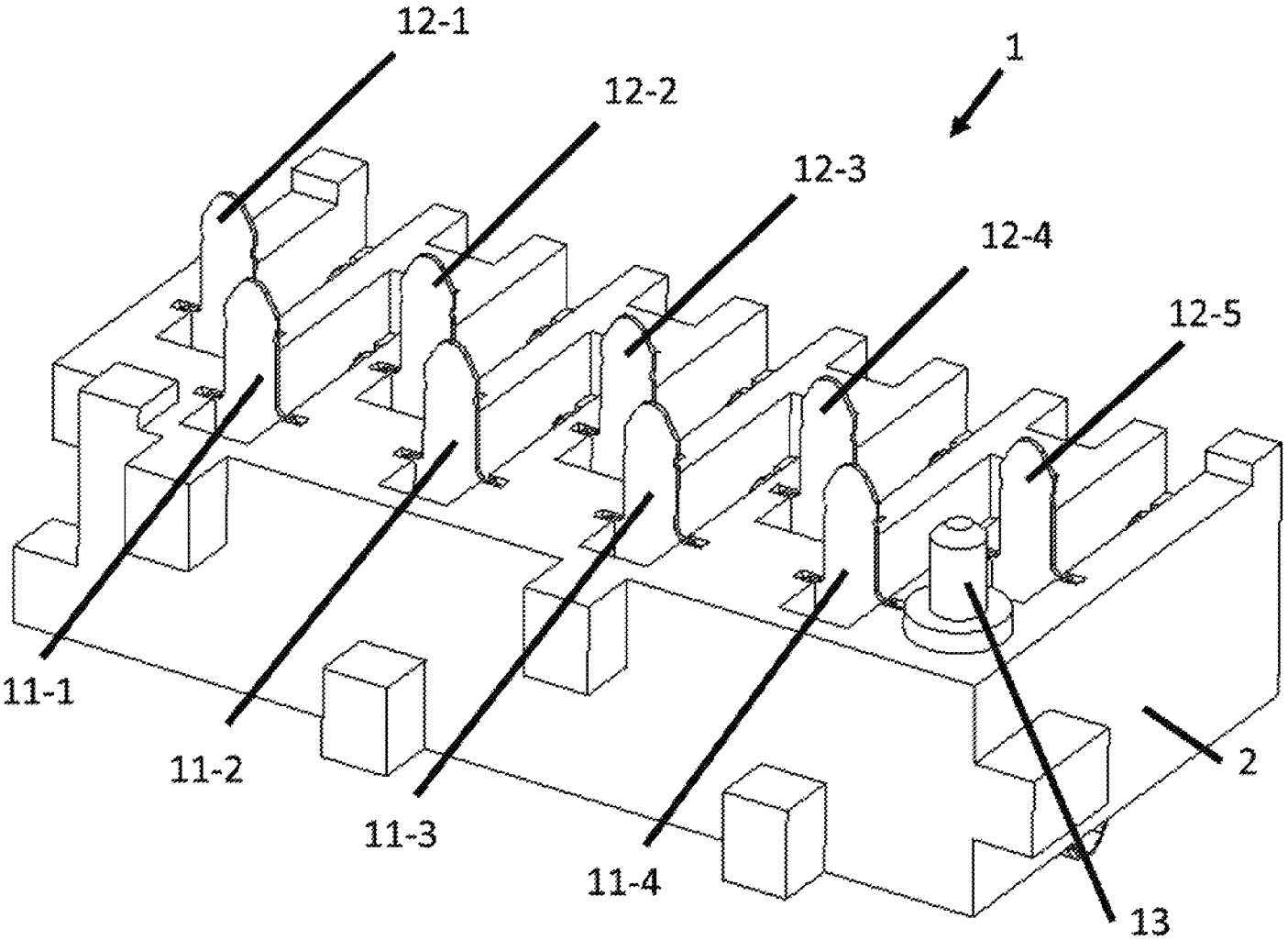
FIG. 2*a* shows a perspective view of the connector module's underside, the connector module being a through-hole component (THC).
Figure 2B:
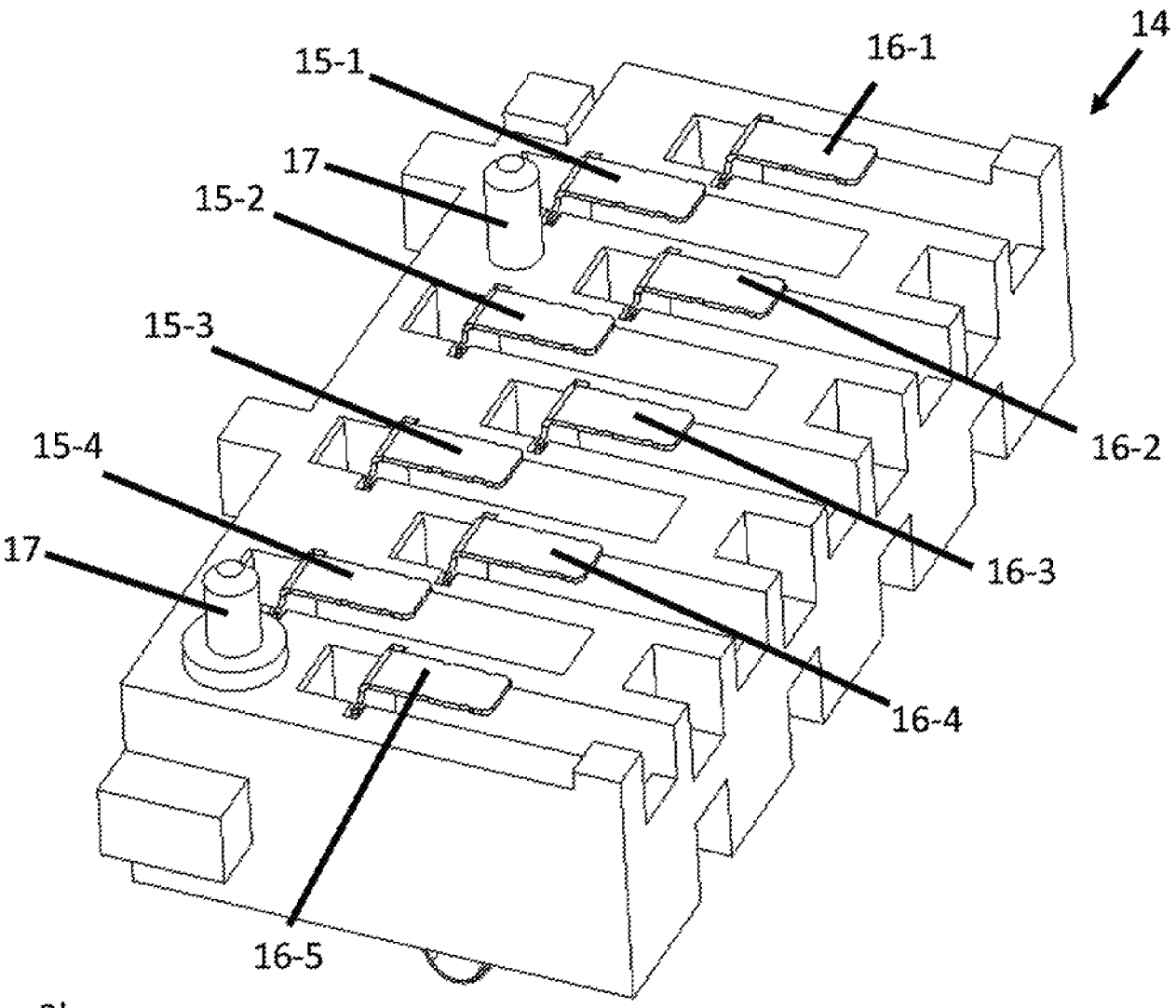
FIG. 2*b* shows a perspective view of a connector module's underside, the connector module being a surface-mounted device (SMD).

In FIGS. 2*a* and 2*b*, two different examples of connector modules are shown. FIG. 2*a* gives a perspective view of the underside of the connector module 1, wherein the connector module 1 is realised as a through-hole component (THC). Accordingly, the solder tabs 11-1 to 11-4 and the solder tabs 12-1 to 12-4 protrude from the connector module's underside and are configured for being inserted into through-holes of a circuit board. The solder tabs 11-1 to 11-4 are part of the signal contact elements 3-1 to 3-4, and the solder tabs 12-1 to 12-5 are part of the shield contact elements 4-1 to 4-5. Furthermore, a positioning pin 13 is disposed at the connector module's underside. The positioning pin 13 is configured for being inserted into a corresponding hole of the circuit board.

FIG. 2*b* shows the underside of a connector module 14 realised as a SMD (surface-mounted device). As shown in FIG. 2*b*, the solder tabs 15-1 to 15-4 and 16-1 to 16-5 are bent in a way that planar surfaces for soldering the device to a circuit board are obtained. Two positioning pins 17 are disposed at the bottom of the connector module 14 to facilitate positioning of the connector module 14 on the circuit board.

Figure 3A:
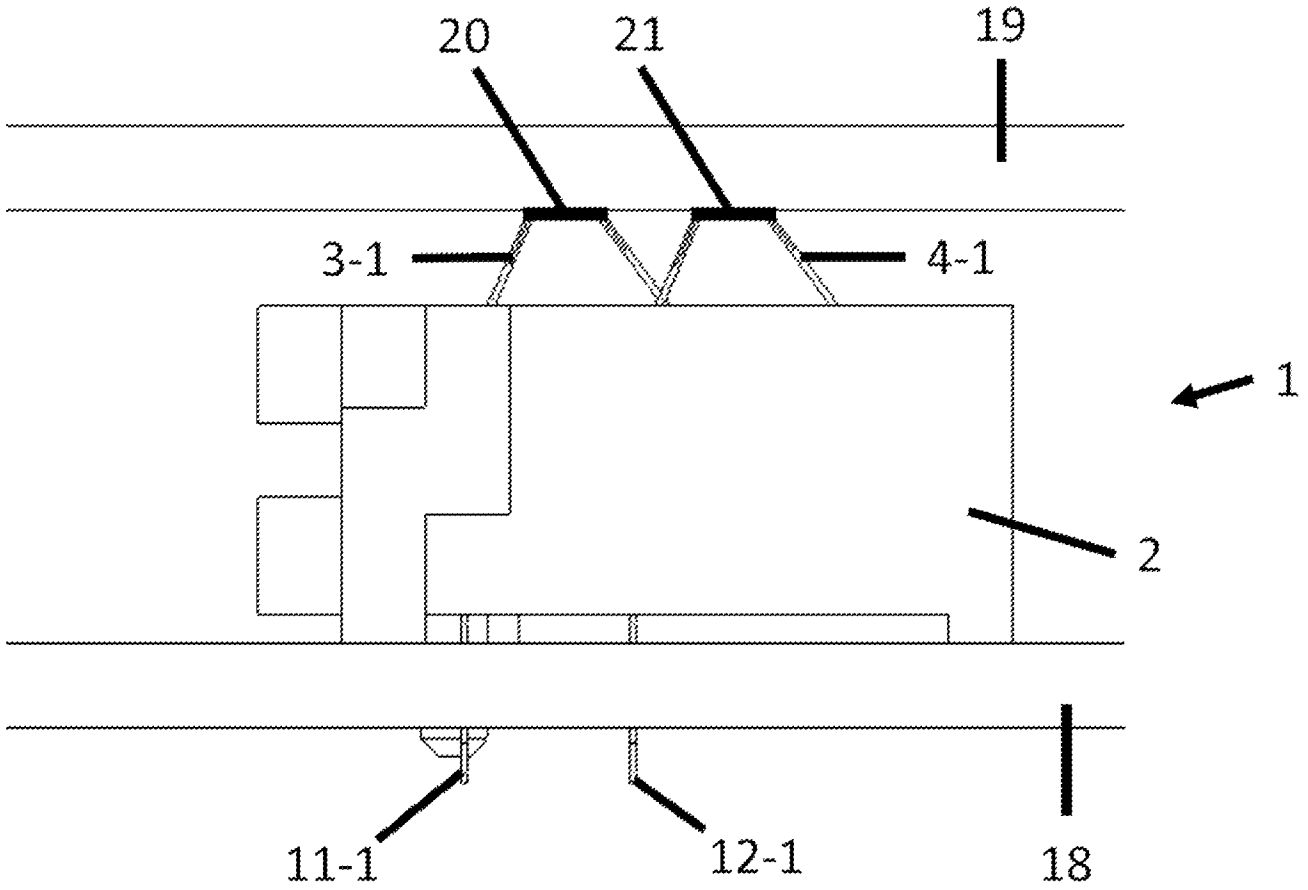
FIG. 3*a* shows a side view of the connector module together with a first circuit board and a second circuit board.

FIG. 3*a* shows a connector module 1 mounted on a first circuit board 18, with the solder tabs 11-1 to 11-4 and 12-1 to 12-5 extending through corresponding through-holes of the first circuit board 18. The solder tabs 11-1 to 11-4 and 12-1 to 12-5 are soldered to conductive paths of the circuit board 18. The solder tabs 11-1 to 11-4 are part of the signal contact elements 3-1 to 3-4 and the solder tabs 12-1 to 12-5 are part of the shield contact elements 4-1 to 4-5. The contact tips of the signal contact elements 3-1 to 3-4 and of the shield contact elements 4-1 to 4-5 protrude from the connector face 5 and are configured for being pressed against the surface of a second circuit board 19. When the first circuit board 18 and the connector module 1 are pressed against the second circuit board 19, the contact tips of the signal contact elements 3-1 to 3-4 and of the shield contact elements 4-1 to 4-5 are pressed against corresponding contact tabs 20, 21 of the second circuit board 19. Thus, respective electrical connections are established between the connector module 1 and the second circuit board 19, for example between the signal contact element 3-1 and the corresponding contact tab 20 and between the shield contact element 4-1 and the corresponding contact tab 21.

Due to the friction between the contact tips and the contact pads, a self-cleaning of the contact surfaces is accomplished.

Figure 3B:
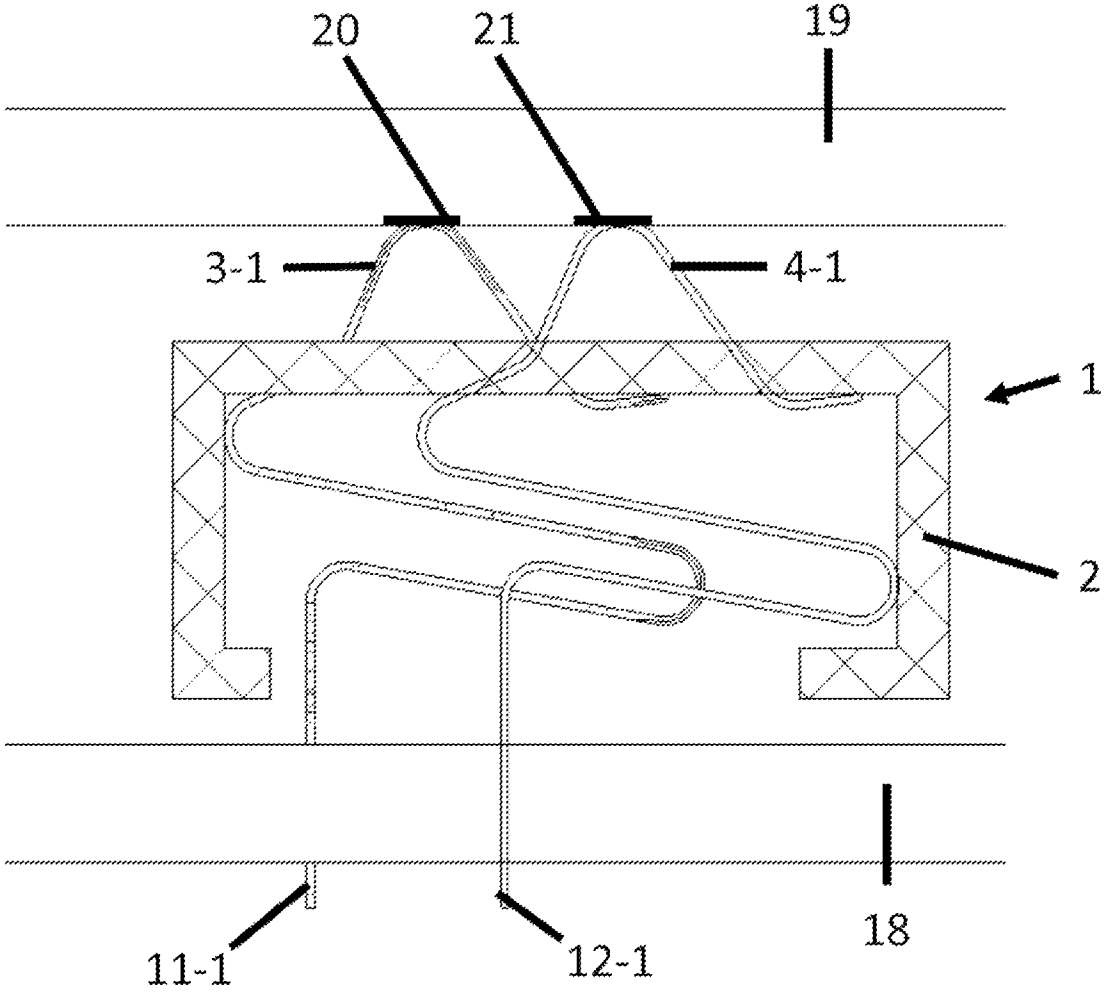
FIG. 3*b* shows a sectional view of the connector module together with the first and the second circuit board.

FIG. 3*b* shows a cross-section of the connector module 1 in a transverse plane. The signal contact element 3-1 and the shield contact element 4-1 are disposed in the insulating body 2. The signal contact element 3-1 and the shield contact element 4-1 are realised as S-shaped contact elements made of a metal strip or a wire. For example, the S-shaped contact elements may be manufactured as stamped sheet metal parts. The signal contact element 3-1 comprises a solder tab 11-1 and the shield contact element 4-1 comprises a solder tab 12-1, the solder tabs 11-1 and 12-1 being soldered to the first circuit board 18. The contact tips of the signal contact element 3-1 and of the shield contact element 4-1 are pressed against the contact pads 20, 21 of the second circuit board 19. The signal contact element 3-1 and the shield contact element 4-1 are subjected to a compression.

Figure 3C:
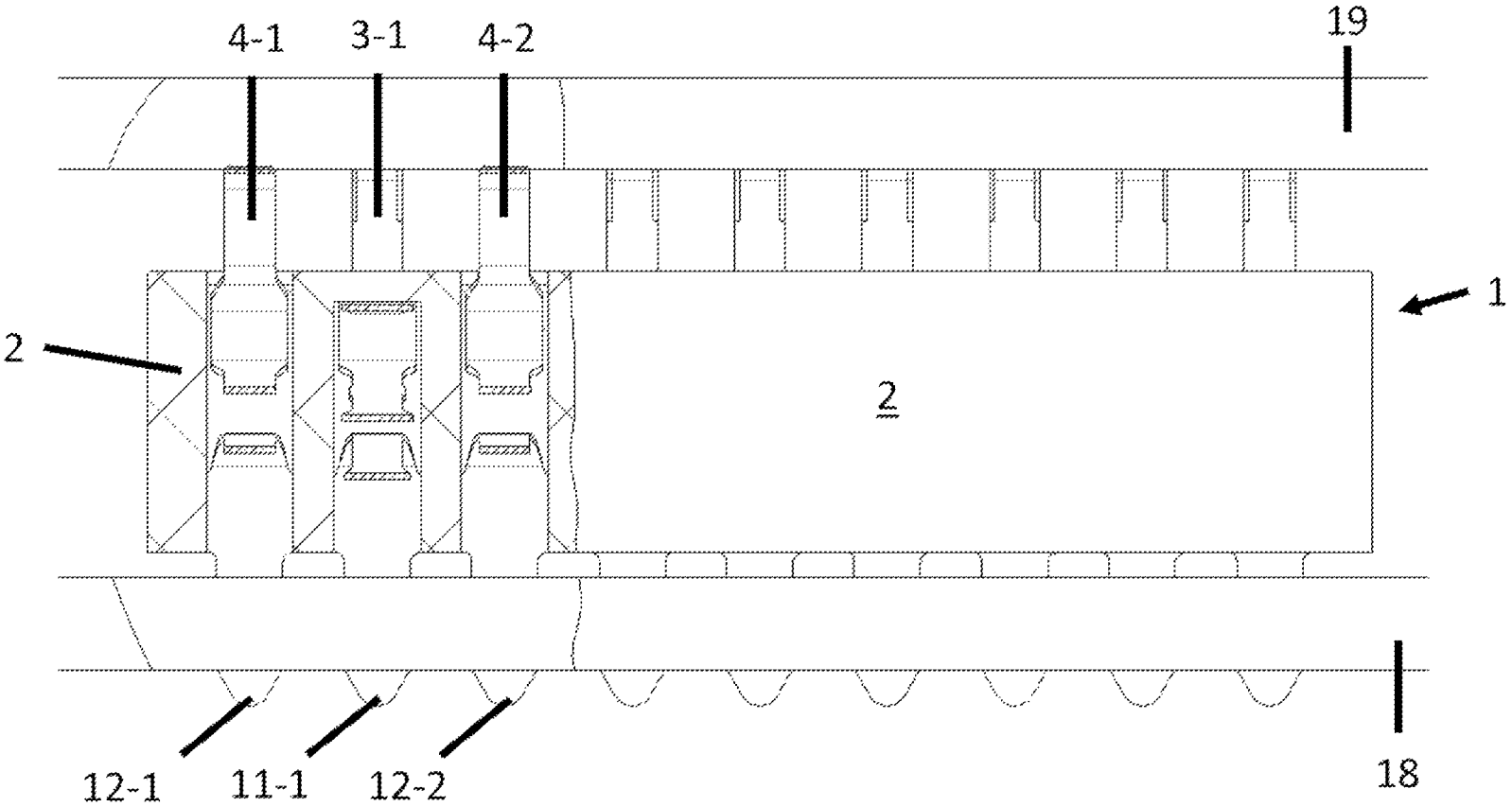
FIG. 3*c* shows a lateral view of the connector module together with the first and the second circuit board.

FIG. 3*c* shows a side view of the connector module 1 together with the first circuit board 18 and the second board 19. In the insulating body 2, the shield contact elements 4-1 to 4-5 and the signal contact elements 3-1 to 3-4 are arranged alternatingly along the longitudinal direction of the connector module 1. The solder tabs 12-1 to 12-5 and 11-1 to 11-4 extend through corresponding through-holes of the first circuit board 18 and are soldered to tracks of the first circuit board 18. The contact tips of the shield contact elements 4-1 to 4-5 and the signal contact elements 3-1 to 3-4 are pressed against contact pads or tracks disposed at the surface of the second circuit board 19 in order to establish electrical contacts with these circuit pads or tracks. Due to the presence of the shield contact elements 4-1 to 4-5, a HF transmission of high quality can be accomplished.

As shown in FIG. 3*b*, both the signal contact elements 3-1 to 3-4 and the shield contact elements 4-1 to 4-5 are realised as spring contact elements, in particular as S-shaped contact elements. The S-shaped contact elements may for example be made of a strip of metal or of a bent wire. For example, the S-shaped contact elements can be realised as stamped sheet metal parts which can be manufactured at low cost. Preferably, both the signal contact elements and the shield contact elements are formed as identical parts, which provides for an improved shielding.

Figure 4:
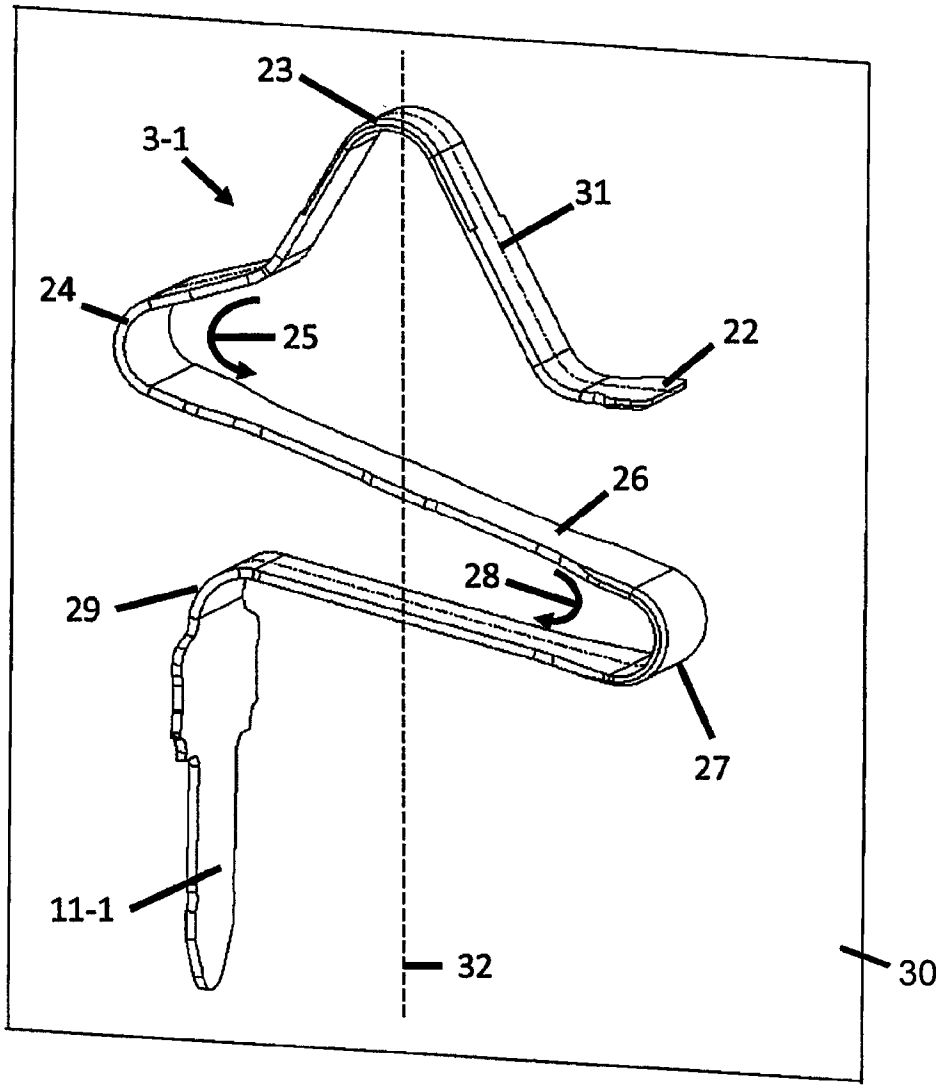
FIG. 4 shows an S-shaped contact that is used both as a shield contact element and as a signal contact element.

FIG. 4 shows the shape of the signal contact element 3-1. Preferably, the signal contact elements 3-1 to 3-4 and the shield contact elements 4-1 to 4-5 are of equal shape. By implementing both the signal contact elements and the shield contact elements as identical contact elements, shielding of HF signal transmission is improved. The signal contact element 3-1 and the other contact elements of the connector module 1 are made of a conductive material, preferably metal and do not comprise any insulating layers.

As shown in FIG. 4, the signal contact element 3-1 is an S-shaped contact element having a characteristic zigzag pattern with a series of turns, angles or alterations in course. The signal contact element 3-1 comprises an end piece 22 and a contact tip 23 that protrudes from the connector face 5 of the connector module 1. The signal contact element 3-1 further comprises a bent portion 24 in which the metal strip describes a first turn in the counterclockwise direction, as indicated by arrow 25. A transverse part 26 connects the first bent portion 24 with a second bent portion 27, the transverse part 26 extending across most of the width of the signal contact element 3-1, for example across at least 70% of the width. In the second bent portion 27, the metal strip makes a second turn in the clockwise direction as indicated by arrow 28. Accordingly, the second bent portion 27 has a second curvature in the opposite direction of curvature than the contact element's first bent portion 24. After another turn 29, the metal strip extends into the solder tab 11-1 of the signal contact element 3-1. In FIG. 4, the first bent portion 24 and the second bent portion 27 are implemented as C-shaped portions, but they may as well form a sharp angle. In this case, at least one of the first bent portion 24 and the second bent portion 27 may be implemented as a V-shaped turn.

The signal contact element 3-1 can be compressed in the longitudinal direction, which will incur a corresponding deformation of the first bent portion 24 and the second bent portion 27. Thus, a spring deflection of the signal contact element 3-1 in the range of for example 2 mm is obtained.

For describing the orientation of the signal contact element 3-1, a centre plane 30 is shown in FIG. 4, the centre plane being defined by the course of the metal strip. In particular, the centre plane 30 extends through a centre line 31 of the metal strip. Furthermore, the longitudinal axis 32 of the signal contact element 3-1 is indicated. The longitudinal axis 32 extends through the centre of mass of the signal contact element 3-1.

Figure 5A:
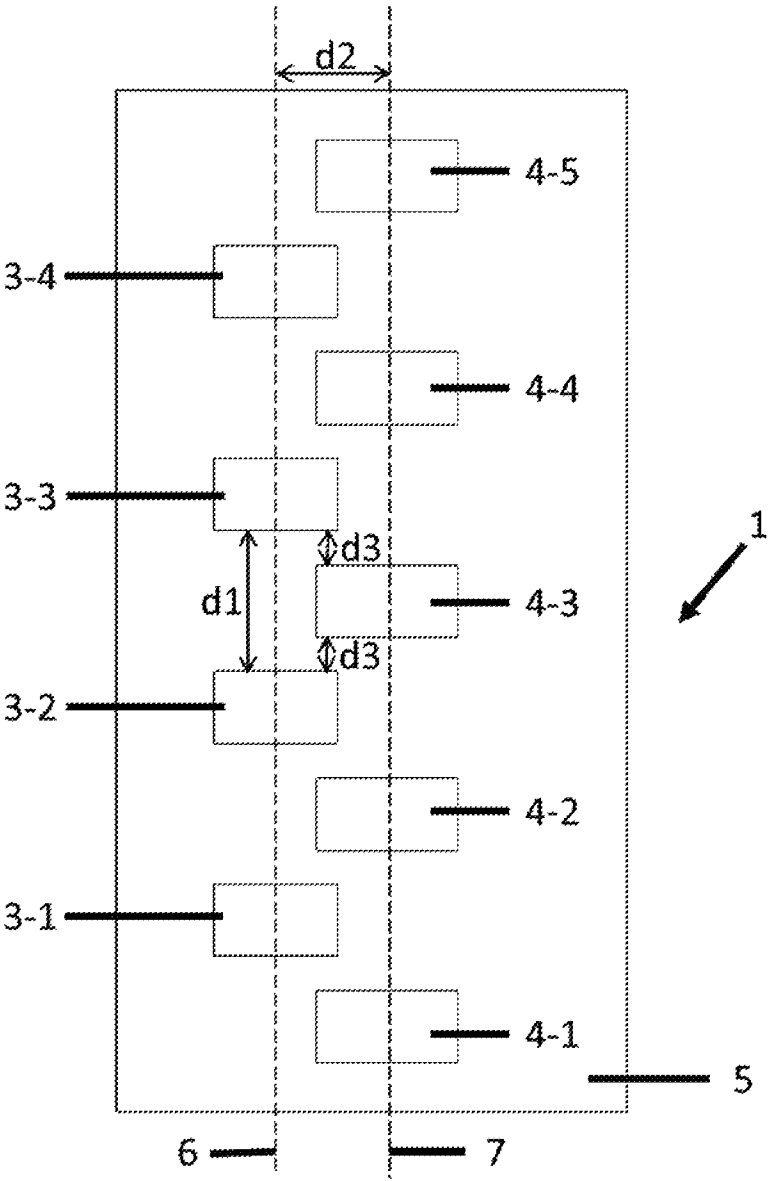
FIG. 5*a* shows a first example of an arrangement of signal contact elements and shield contact elements on a connector module.

FIG. 5*a* shows a top view of the connector module 1. The signal contact elements 3-1 to 3-4 are arranged along the straight line 6 at equidistant spacing, with d1 denoting the distance between neighbouring signal contact elements. The shield contact elements 4-1 to 4-5 are arranged along a straight line 7 at equidistant spacing. The straight line 7 is parallel to the straight line 6, with the distance between the two straight lines 6 and 7 being denoted as d2. When viewed in the direction of the second straight line 7, the positions of the shield elements 4-1 to 4-5 are shifted relative to the positions of the signal contact elements 3-1 to 3-4 by half of the spacing of neighbouring signal contact elements. Accordingly, the signal contact elements 3-1 to 3-4 are positioned at intermediate positions between neighbouring shield contact elements 4-1 to 4-5. This results in a characteristic zigzag arrangement of the signal contact elements 3-1 to 3-4 and the shield contact elements 4-1 to 4-5. When viewed in the direction of the straight lines 6 and 7, the shield contact elements 4-1 to 4-5 and the signal contact elements 3-1 to 3-4 are arranged in an alternating order. Thus, each of the signal contact elements 3-1 to 3-4 is shielded by two associated shield contact elements.

In the arrangement of contact elements shown in FIG. 5*a*, for each signal contact element, two associated shield contact elements are located at a distance from the signal contact element that is less than the distance d1 between neighbouring signal contact elements. For example, in the surrounding of the signal contact element 3-3, the two shield contact elements 4-3, 4-4 are located at a distance d3 from the signal contact element 3-3, with d3 being smaller than d1. Accordingly, the two associated shield contact elements 4-3 and 4-4 will predominantly contribute to the shielding of the HF signal transmitted via the signal contact element 3-3. The shield contact elements 4-2, 4-3 and 4-4 are located at intermediate positions between two signal contact elements, and for this reason, they contribute to the shielding of two different signal contact elements. By sharing the shield contact elements between two subsequent signal contact elements, the total number of shield contact elements is reduced. In the example shown in FIG. 5*a*, the number of shield contact elements exceeds the number of signal contact elements by one.

In order to accomplish an effective shielding, the signal contact elements 3-1 to 3-4 and the shield contact elements 4-1 to 4-5 are oriented in parallel or at least essentially in parallel, which shall mean that the orientation of the contact elements' centre planes may deviate from one another by at most 5°. Preferably, the signal contact elements 3-1 to 3-4 and the shield contact elements 4-1 to 4-5 are oriented in a direction perpendicular to the connector face 5. Alternatively, the signal contact elements 3-1 to 3-4 and the shield contact elements 4-1 to 4-5 may be inclined by a predefined inclination angle relative to the connector face 5, with the contact elements and the connector face between them enclosing an angle of more than 60°. Due to the parallel orientation of the contact elements, the signal contact elements and the associated shield contact elements act as capacitors, which implies that HF fields emanating from the signal contact elements 3-1 to 3-4 are effectively shielded. In this regard, it is particularly important that the S-shaped contact elements comprise a transverse part 26. The transverse part 26 extends over most of the width of the contact element and subdivides the contact element into different compartments. This compartmentation hinders the HF field from extending through the S-shaped shield contact elements. In this regard, the parallel arrangement of signal contact elements and shield contact elements resembles a plate capacitor.

In order to accomplish a HF signal transmission of high quality, the impedance between a signal contact element and the associated shield contact elements should be matched with the impedance of the electric connector and the cable. If the impedance is properly set to for example 50Ω, signal reflections, which would impair the quality of the HF signal, can be avoided.

Figure 5B:
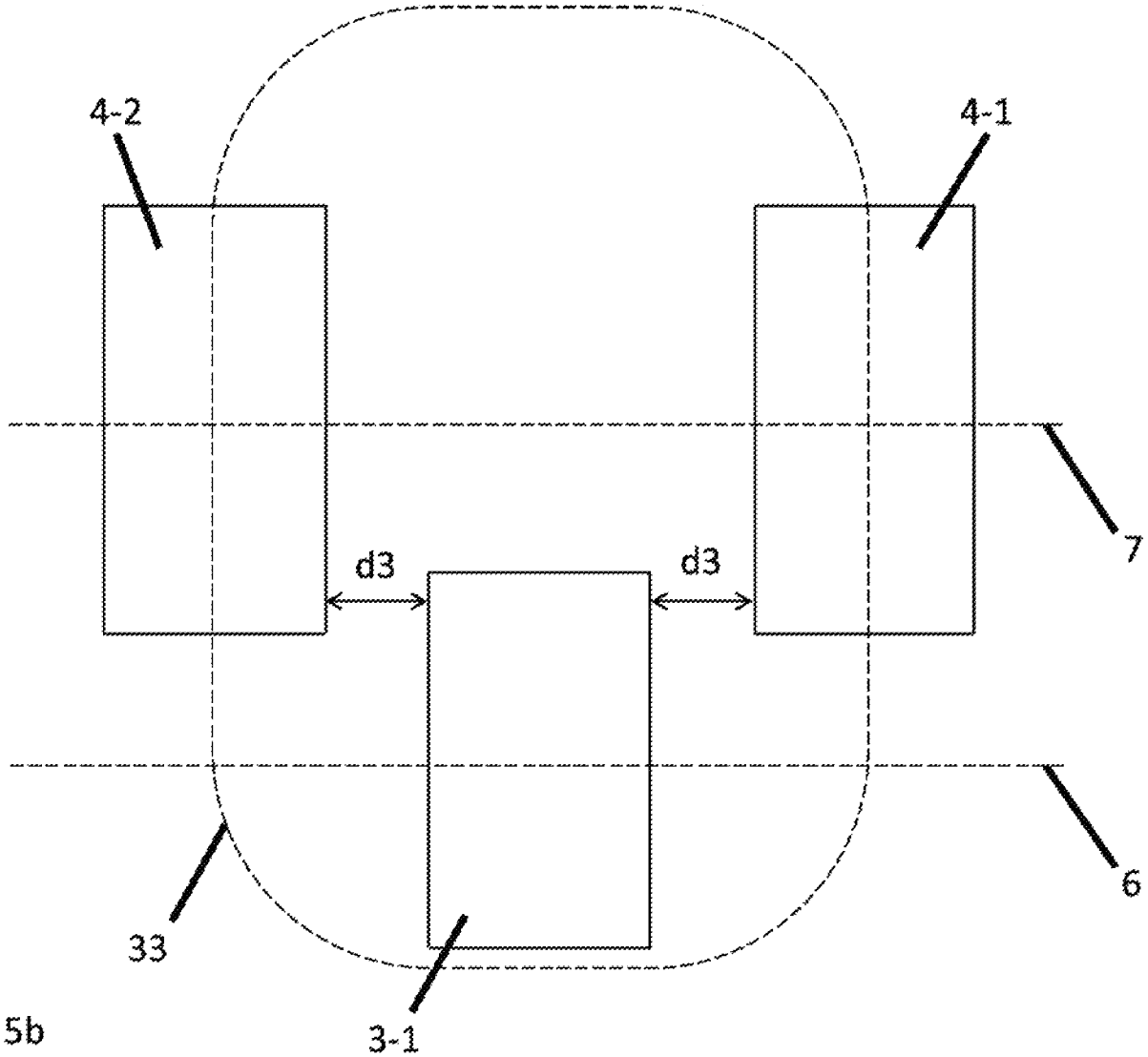
FIG. 5*b* shows the impedance-controlled area surrounding a signal contact element.

In this regard, FIG. 5*b* illustrates the requirements imposed on the connector module 1. FIG. 5*b* shows a top view of the signal contact element 3-1 and of its associated shield contact elements 4-1 and 4-2 together with an impedance-controlled area 33 that surrounds the signal contact element 3-1. In order to bring the impedance to a desired value, the insulating material of the insulating body 2 can be selected in a suitable manner. Secondly, the size of the air-filled cavities shown in FIGS. 2*a* and 2*b* can be varied, in order to adjust the impedance. Thirdly, the distance d2 between the first straight line 6 and the second straight line 7 can be varied, which will in turn affect the distance d3 between the signal contact element 3-1 and the associated shield contact elements 4-1 and 4-2. As a result of these measures, the impedance-controlled area 33 can be manufactured such that a desired impedance is obtained. Thus, signal reflections of the HF signal are minimised.

Figure 6:
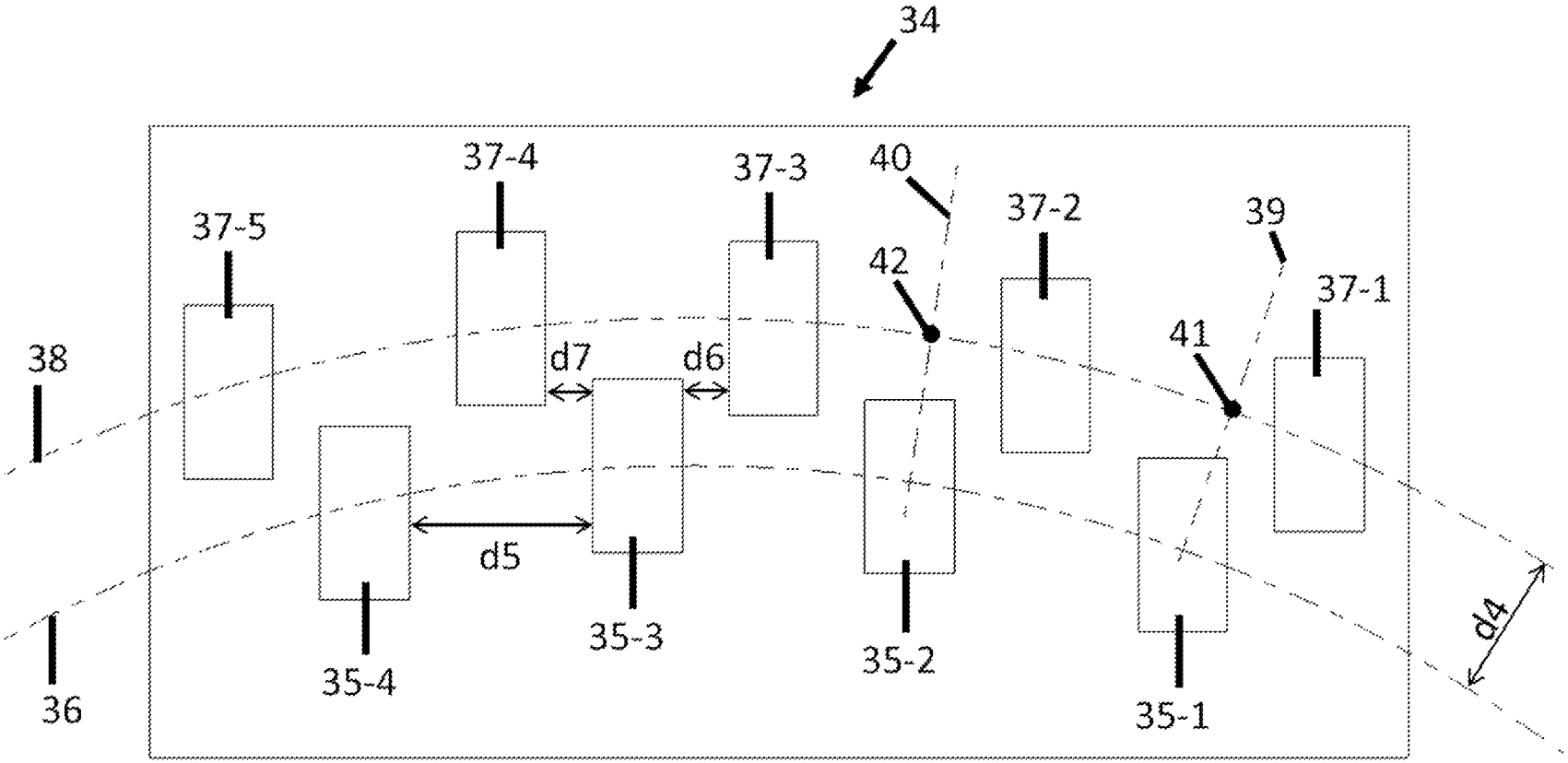
FIG. 6 shows a second example of an arrangement of signal contact elements and shield contact elements on a connector module.

FIG. 6 shows yet another example of a connector module 34. In contrast to FIG. 5*a*, the signal contact elements 35-1 to 35-4 are arranged at equidistant spacing along a first curve 36, and the shield contact elements 37-1 to 37-5 are arranged at equidistant spacing along the second curve 38, with the curves 36 and 38 being parallel curves. A parallel curve is a curve whose points are at a fixed distance from a given curve. This implies that the distance d4 between the two curves, which is determined in a direction perpendicular to the curves, is a constant. The curves 36, 38 may for example be arched curves.

In FIG. 6, the shield contact elements 37-2, 37-3 and 37-4 are located at intermediate positions between the signal contact elements 35-1 to 35-4. For determining these intermediate positions, it is assumed that a first transverse plane 39 extends through the position of the signal contact element 35-1 and a second transverse plane 40 extends through the position of the second signal contact element 35-2. In this case, the first transverse plane 39 intersects with the second curve 38 at a first intersection point 41 and the second transverse plane 40 intersects with the second curve 38 at a second intersection point 42. Now, the shield contact element 37-2 is located on the second curve 38 halfway between a first intersection point 41 and the second intersection point 42.

For each of the signal contact elements 35-1 to 35-4 shown in FIG. 6, two associated shield contact elements are located at a distance from the signal contact element that is less than the distance d5 between neighbouring signal contact elements. For example, it can be seen in FIG. 6 that for the signal contact element 35-3, the distances d6, d7 between the signal contact element 35-3 and the two associated shield contact elements 37-3 and 37-4 is less than the distance d5 between neighbouring signal contact elements. Accordingly, the two shield contact elements 37-3 and 37-4 are responsible for shielding the HF field emanating from the signal contact element 35-3.

Figure 7:
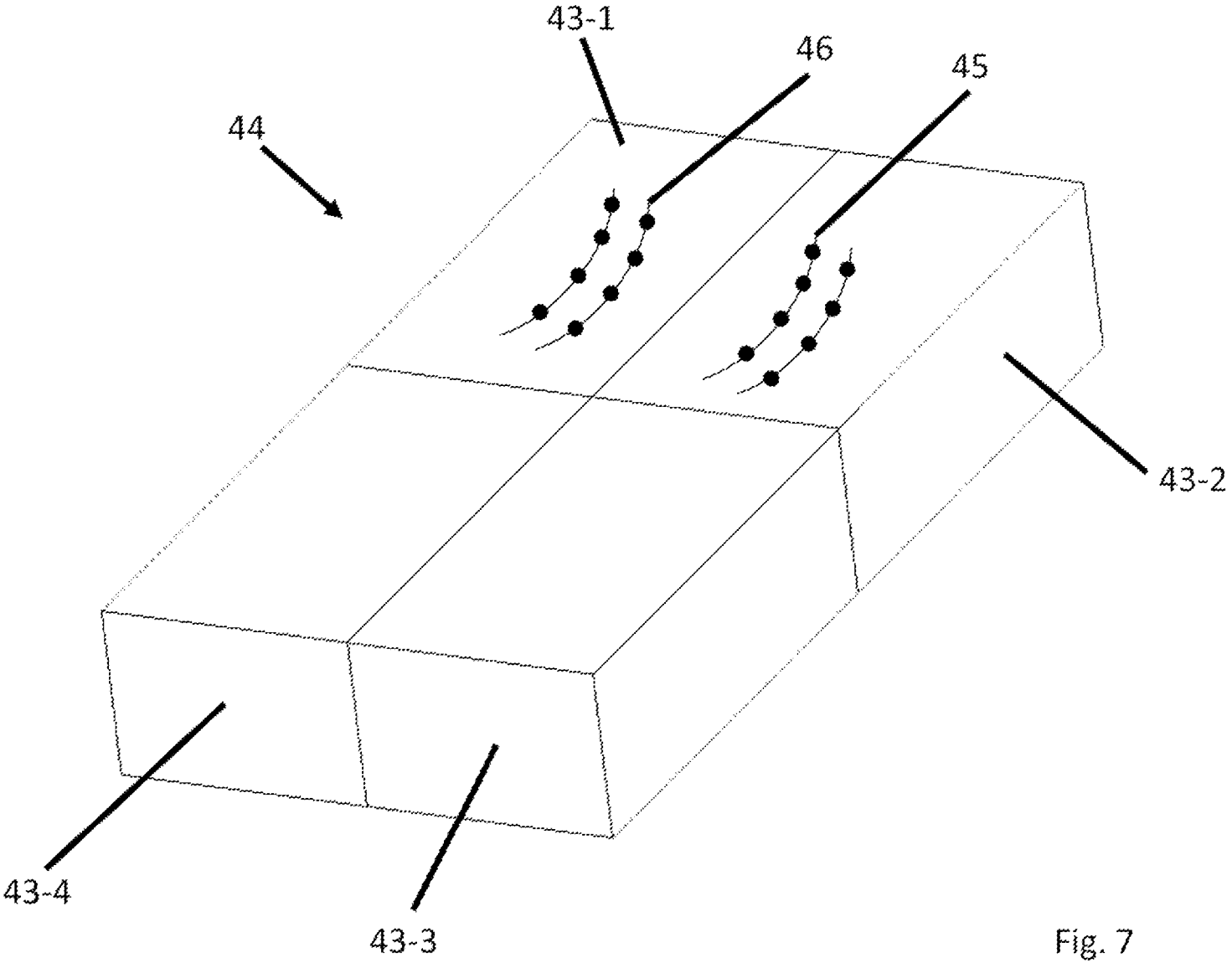
FIG. 7 shows an array comprising four connector modules.

FIG. 7 illustrates that a plurality of connector modules 43-1 to 43-4 can be assembled to form an array 44 of connector modules. The array 44 of connector modules may then be used as a component of an electric connector. In this array 44, a row 45 of shield contact elements of the connector module 43-2 may contribute to the shielding of a row 46 of signal contact elements disposed on the neighbouring connector module 43-1.

The features as described in the above description, claims and figures can be relevant individually or in any combination to realise the various embodiments of the invention.

LIST OF REFERENCE NUMERALS

1 connector module
2 insulating body
3-1 to 3-4 signal contact elements
4-1 to 4-5 shield contact elements
5 connector face
6 first straight line
7 second straight line
8 protruding element
9 rectangular recess
10 spring deflection
11-1 to 11-4 solder tabs for signal contact elements
12-1 to 12-5 solder tabs for shield contact elements
13 positioning pin
14 connector module
15-1 to 15-4 solder tabs for signal contact elements
16-1 to 16-5 solder tabs for shield contact elements
17 positioning pins
18 first circuit board
19 second circuit board
20 contact pad
21 contact pad
22 end piece
23 contact tip
24 first bent portion
25 arrow
26 transverse part
27 second bent portion
28 arrow
29 turn
30 centre plane
31 centre line
32 longitudinal axis
33 impedance-controlled area

34 connector module
35-1 to 35-4 signal contact elements
36 first curve
37-1 to 37-5 shield contact elements
38 second curve
39 first transverse plane
40 second transverse plane
41 first intersection point
42 second intersection point
43-1 to 43-4 connector modules
44 array of connector modules
45 row of shield contact elements
46 row of signal contact elements

The invention claimed is:

1. A connector module comprising an insulating body, a plurality of signal contact elements, a plurality of shield contact elements, the signal contact elements and the shield contact elements forming a connector face configured for establishing electric contact with a counterpart of the connector module, the connector face's contact elements consisting of a first line of signal contact elements and a second line of shield contact elements, the first line and the second line extending in the connector face of the connector module, wherein the signal contact elements of said plurality of signal contact elements are arranged along said first line and the shield contact elements of said plurality of shield contact elements are arranged along said second line, wherein for each of the signal contact elements, there exist two shield contact elements that are closer to this signal contact element than any signal contact element of the plurality of signal contact elements, the first line and the second line being parallel lines having a normal distance, wherein, viewed along the course of the parallel lines, the signal contact elements and the shield contact elements are arranged alternatingly.

2. The connector module according to claim 1, wherein the closest distances between a signal contact element and any one of the signal contact element's associated shield contact elements are equal to one another.

3. The connector module according to claim 1, wherein the signal contact elements are arranged along the first line at regular spacing intervals and the shield contact elements are arranged along the second line at regular spacing intervals.

4. The connector module according to claim 1, wherein along the course of the parallel lines, the signal contact elements are disposed at intermediate positions between neighboring shield contact elements, respectively.

5. The connector module according to claim 1, wherein for each pair of neighboring shield contact elements, one signal contact element is disposed at an intermediate position between the neighboring shield contact elements of said pair, respectively.

6. The connector module according to claim 1, wherein the signal contact elements are arranged along a first straight line at the connector face of the connector module, wherein the shield contact elements are arranged along a second straight line at the connector face of the connector module, the second straight line being parallel to the first straight line.

7. The connector module according to claim 6, wherein the positions of the shield contact elements along the second straight line are shifted in the direction of the second straight line relative to the positions of the signal contact elements along the first straight line by half the spacing between neighboring signal contact elements.

8. The connector module according to claim 1, wherein the signal contact elements and the shield contact elements have the same shape.

9. The connector module according to claim 1, wherein the signal contact elements and the shield contact elements are formed as S-contacts, wherein the S-contact comprises at least a first portion with a first turn having a first curvature direction and a second portion with a second turn having a second curvature direction, the second curvature direction being opposite to the first curvature direction.

10. The connector module according to claim 1, wherein the signal contact elements and the shield contact elements are oriented essentially parallel to each other.

11. The connector module according to claim 1, which is configured for establishing electric connections with conducting paths and/or contact pads of a second circuit board when the connector face of the connector module is pressed against the second circuit board.

12. The connector module according to claim 1, wherein the signal contact elements are configured for transmitting HF signals with frequencies above 20 MHz.

13. An array of connector modules comprising at least two connector modules according to claim 1, wherein the at least two connector modules are combined to form an array.

14. An electric connector comprising at least one connector module according to claim 1, the connector module being configured and arranged such that the signal contact elements and the shield contact elements of the connector module can establish electrical contacts with contact pads and/or conducting paths of the counterpart.

15. A connector module comprising an insulating body, a plurality of signal contact elements, a plurality of shield contact elements, the signal contact elements and the shield contact elements forming a connector face configured for establishing electric contact with a counterpart of the connector module, wherein for each of the signal contact elements, there exist two or at most three shield contact elements that are closer to this signal contact element than any signal contact element of the plurality of signal contact elements, wherein the shield contact elements are formed as S-contacts comprising at least a first portion with a first turn having a first curvature direction and a second portion with a second turn having a second curvature direction, the second curvature direction being opposite to the first curvature direction, and wherein the S-shape of the shield contact element provides three or more adjacent traverse parts connected by the curved portions.

* * * * *